US005367967A

United States Patent [19]

Lin

[11] Patent Number: 5,367,967

[45] Date of Patent: Nov. 29, 1994

[54] BLIND STITCH SEWING MACHINE

[76] Inventor: Teng-Chin Lin, No.211, Sec.2, Chung-Te Rd., Taichung City, Taiwan, Prov. of China

[21] Appl. No.: 11,520

[22] Filed: Feb. 1, 1993

[51] Int. Cl.[5] ..... D05B 1/24

[52] U.S. Cl. ..... 112/176

[58] Field of Search ..... 112/176, 178, 177, 267.1, 112/268.1

[56] References Cited

U.S. PATENT DOCUMENTS

| | | | |
|---|---|---|---|
| 2,157,032 | 5/1939 | Strobel | 112/176 |
| 5,178,082 | 1/1993 | Moll et al. | 112/178 |
| 5,182,999 | 2/1993 | Dietl | 112/178 |

*Primary Examiner*—Peter Nerbun
*Attorney, Agent, or Firm*—Baker & Daniels

[57] ABSTRACT

An improved blind stitch sewing machine includes a machine table, a main housing fixed on the machine table, a head housing located at one side of the main housing, a needle mechanism unit coupled with the head housing, a driving unit coupled with the machine table and adapted to drive the needle mechanism unit, and a fabric pushing member coupled with the driving unit. The driving unit includes a main shaft, an auxiliary shaft, a first transmission assembly and a second transmission assembly. The main shaft is journalled on the main housing and is drivable to effect a unidirectional rotation. The first transmission assembly interconnects the main shaft and the auxiliary shaft so as to convert the uni-directional rotation of the main shaft into reciprocal rotation of the auxiliary shaft. The second transmission assembly interconnects the auxiliary shaft and the fabric pushing member so as to convert the reciprocal rotation of the auxiliary shaft into reciprocal vertical movement of the fabric pushing member.

2 Claims, 9 Drawing Sheets

BLIND STITCH SEWING MACHINE

BACKGROUND OF THE INVENTION

1. Field Of The Invention

This invention relates to a blind stitch sewing machine, more particularly to a sewing machine which can feed a fabric unit smoothly in a forward direction when sewing.

2. Description Of The Related Art

Referring to FIGS. 1, 2 and 3, a conventional blind stitch sewing machine includes a main housing (10) which is fixed on a machine table (9), a head housing (11), a horizontal stationary plate (12), a presser member (13), a feed dog element (not shown), a rotating shaft (14), a fabric pushing member (15) and a needle unit (16). The head housing (11) is located at one side of the main housing (10). A motor (not shown) and some necessary mechanism (not shown) are adapted to be installed in the main and head housings (10,11). The stationary plate (12) is connected securely to the lower portion of the head housing (11) and has a stitching slot formed therein. The presser member (13) is connected movably to the lower portion of the head housing (11) and can be moved to press against the stationary plate (12). The stationary plate (12) and the presser member (13) cooperatively define a fabric passage therebetween. The feed dog element presses a fabric unit (U) (see FIG. 3) against the presser member (13) in such a manner that the feed dog element can be activated to feed the fabric unit (U) for sewing. The needle unit (16) is connected pivotally to the head housing (11) and has a curved needle (17) provided thereon. The needle unit (16) is driven to pivot in order to put stitches on the fabric unit (U). The motor is coupled with the feed dog element and the needle unit (16) so as to drive the feed dog element and the needle unit (16). The rotating shaft (14) is coupled with the motor and can be driven to rotate reciprocally. The fabric pushing member (15) has a rounded end and is connected securely to the main shaft (14) in such a manner that the fabric pushing member (15) rotates synchronously with the main shaft (14). The fabric pushing member (15) can be rotated between a first position, wherein the rounded end of the fabric pushing member (15) pushes a portion of the fabric unit (U) upward and through the stitching slot of the stationary plate (12), and a second position, wherein the rounded end of the fabric pushing member (15) is away from the fabric unit (U). Accordingly, when the fabric pushing member (15) is moved to the first position, the needle unit (16) is moved pivotally so as to put one of the stitches on the fabric unit (U). When one of the stitches has been put on the portion of the fabric unit (U), the fabric pushing member (15) is moved to the second position while the feed dog element is activated so as to feed the fabric unit (U) forward in order to put a succeeding one of the stitches on the fabric unit (U).

The drawback of the above-described conventional blind stitch sewing machine is that the rotating speed of the fabric pushing member (15) from the first position to the second position is slower than the feeding speed of the feed dog element, thereby resulting in an undesired stitching pattern due to the rough forward movement of the fabric unit (U), as best illustrated in FIG. 4.

SUMMARY OF THE INVENTION

Therefore, the main object of this invention is to provide a blind stitch sewing machine which can feed a fabric unit smoothly in forward direction when sewing so as to prevent the occurrence of an undesired stitching pattern.

According to this invention, a blind stitch sewing machine includes: a machine table; a head housing which is fixed on the machine table and which has a lower portion; a horizontal stationary plate which is connected securely to the lower portion of the head housing and which has a stitching hole formed therein; a presser member which is connected movably to the lower portion of the head housing and which can be moved to press against the stationary plate, the presser member and the stationary plate cooperatively defining a fabric passage therebetween; a feed dog element adapted to press a fabric unit against the presser member in such a manner that the feed dog element can be activated to feed the fabric unit for sewing when the presser member is moved to press against the stationary plate; a needle unit which is connected pivotally to the head housing and which has a needle provided thereon, the needle unit being driven to pivot in order to put stitches on the fabric unit; a driving unit coupled with the feed dog element and the needle unit so as to drive the feed dog element and the needle unit; and a fabric pushing member coupled with the driving unit and activated in order to push a portion of the fabric unit upward and through the stitching hole of the stationary plate, thereby permitting the needle to put one of the stitches on the portion of the fabric unit. The driving unit includes a main shaft journalled on the machine table and drivable to effect a uni-directional rotation, an auxiliary shaft, a first transmission assembly that interconnects the main shaft and the auxiliary shaft so as to convert the uni-directional rotation of the main shaft into reciprocal rotation of the auxiliary shaft, and a second transmission assembly that interconnects the auxiliary shaft and the fabric pushing member so as to convert the reciprocal rotation of the auxiliary shaft into reciprocal vertical movement of the fabric pushing member. When the auxiliary shaft is rotated in one direction, the fabric pushing member is moved to an upper position, wherein the fabric pushing member pushes the portion of the fabric unit upward and through the stitching hole of the stationary plate for sewing; when one of the stitches has been put on the portion of the fabric unit, the auxiliary shaft is rotated in the opposite direction, and the fabric pushing member is moved to a lower position, wherein the fabric pushing member is away from the fabric unit, thereby permitting the feed dog element to feed the fabric unit smoothly in a forward direction in order to put a succeeding one of the stitches on the fabric unit.

BRIEF DESCRIPTION OF THE DRAWINGS

Other features and advantages of the present invention will become apparent in the following detailed description of the preferred embodiment, with reference to the accompanying drawings, of which.

DETAILED DESCRIPTION OF THE PREFERRED EMBODIMENT

Referring to FIGS. 5, 6, 7 and 8, a blind stitch sewing machine according to this invention includes a main housing (20), a needle mechanism (30), a driving unit (40) and a fabric pushing member (55).

Figure 9:
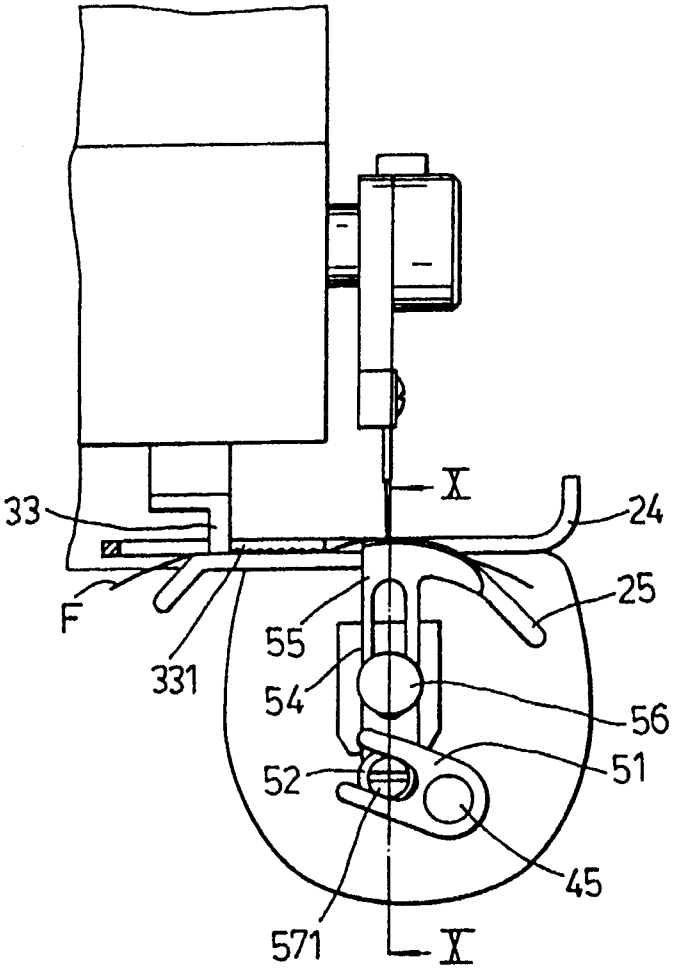
FIG. 9 is a fragmentary side view of the portion of the blind stitch sewing machine shown in FIG. 7.
Figure 12:
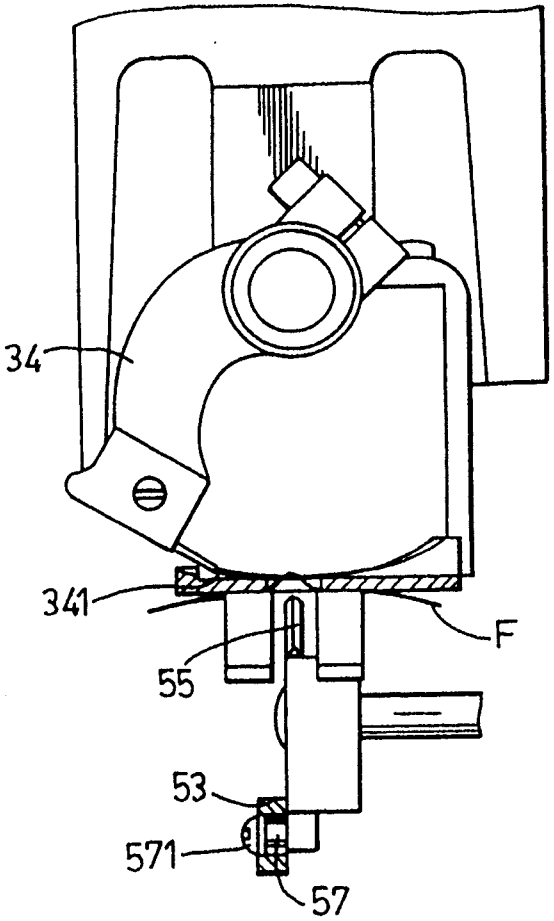
FIG. 12 is a partly sectional view taken along line XII—XII in FIG. 11.
Figure 11:
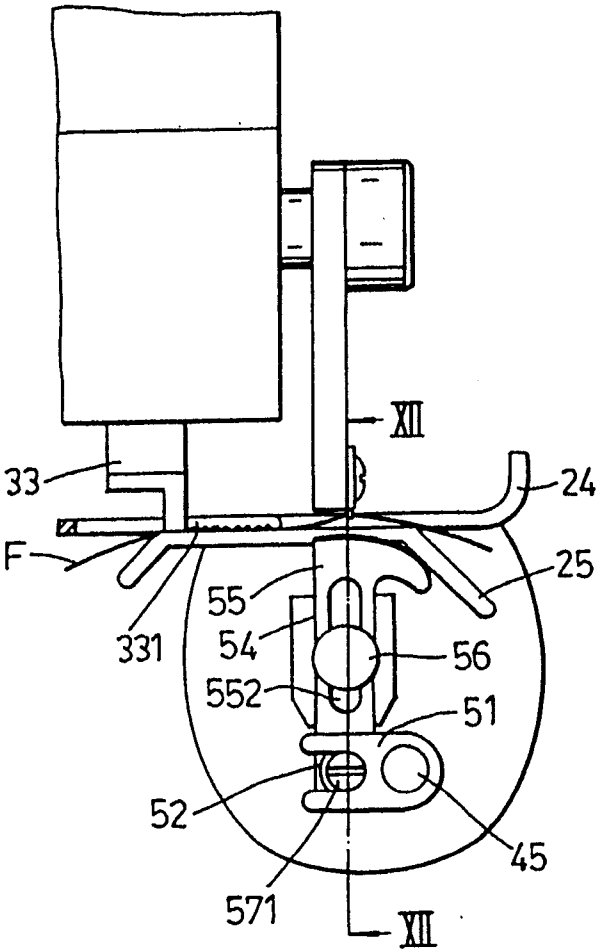
FIG. 11 is another fragmentary side view of the portion of the blind stitch sewing machine shown in FIG. 7.

The main housing (20) is fixed on a machine table (21). A head housing (23) is provided at one side of the main housing (20) and has a lower portion. A horizontal stationary plate (24) is connected securely to the lower portion of the head housing (23) and has a stitching hole (241) formed therein. A presser member (25) is connected movably to the lower portion of the head housing (23) and can be moved to press against the stationary plate (24). The presser member (25) and the stationary plate (24) cooperatively define a fabric passage therebetween. A fabric unit (F) (see FIG. 9) is adapted to extend through the fabric passage.

The needle mechanism (30) includes conventional mechanisms (not shown) disposed in the main and head housings (20,23). A hand wheel (31) is connected rotatably to one side of the main housing (20) away from the head housing (23) and is coupled with the conventional mechanisms so that the conventional mechanisms can be activated when the hand wheel (31) is operated. A thread guiding unit (32) includes a cylindrical rod (321) connected rotatably to the front wall of the head housing (23) and coupled with the conventional mechanisms. The thread guiding unit (32) further includes a thread guiding arm (322) connected to the cylindrical rod (321) so that the guiding arm (322) is rotated synchronously with the cylindrical rod (321) when the cylindrical rod (321) is driven to rotate. A connecting plate (33) is connected movably to the front wall of the head housing (23) and is coupled with the conventional mechanisms so that the connecting plate (33) can be driven to move reciprocally forward and backward. A feed dog element (331) (see FIG. 7) is connected to the connecting plate (33) and moves synchronously with the latter. When the presser member (25) is moved to press against the stationary plate (24), the feed dog element (331) presses the fabric unit (F) against presser member (25) in such a manner that the feed dog element (331) can be driven to feed the fabric unit (F) for sewing. A needle unit (34) is connected pivotally to the head housing (23) and has a needle (341) provided thereon. The needle unit (34) is coupled with the conventional mechanisms so as to be driven to pivot in order to put stitches on the fabric unit (F).

Figure 1:
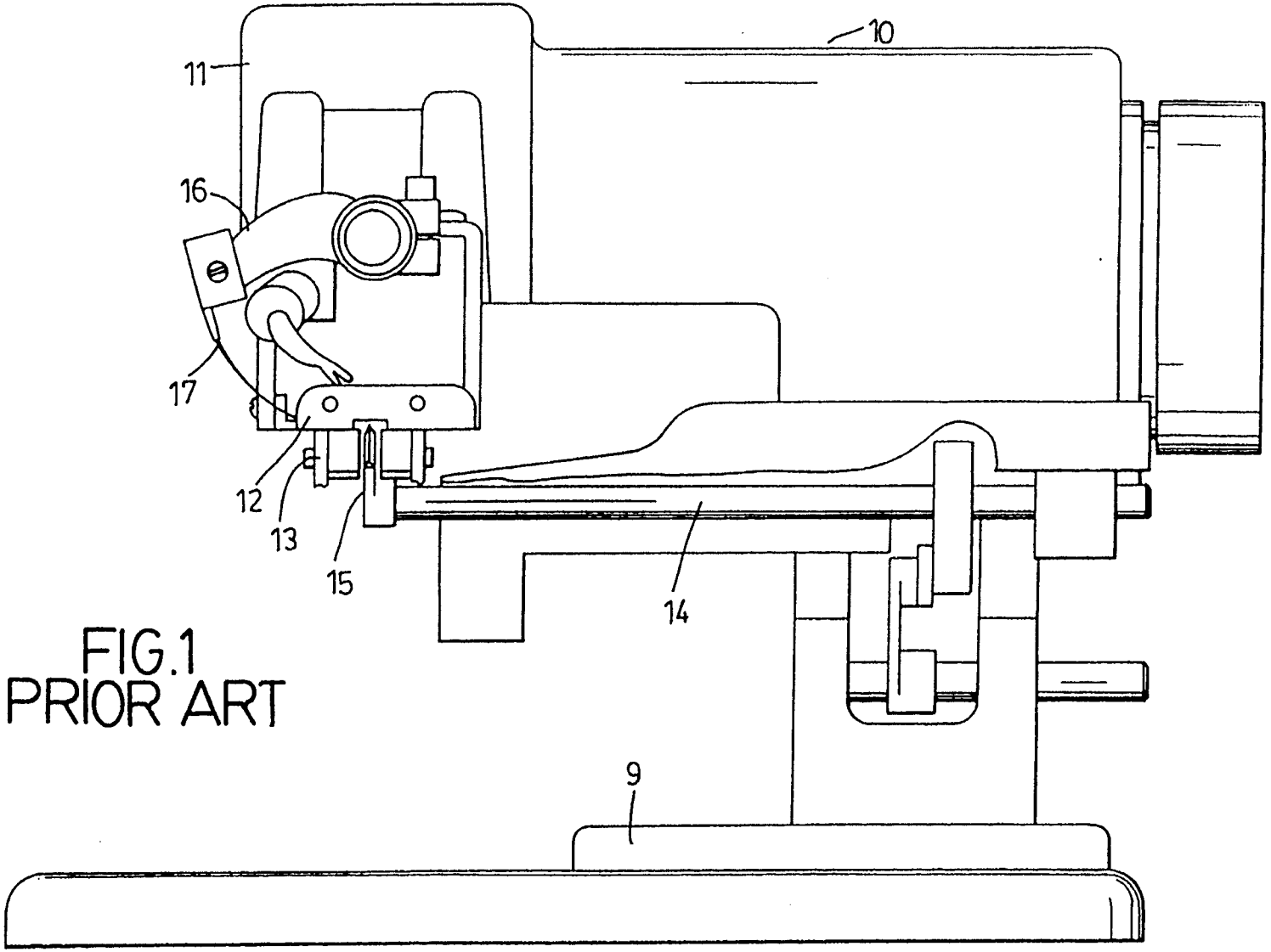
FIG. 1 PRIOR ART
FIG. 1 is a fragmentary front view of a conventional blind stitch sewing machine.
Figure 2:
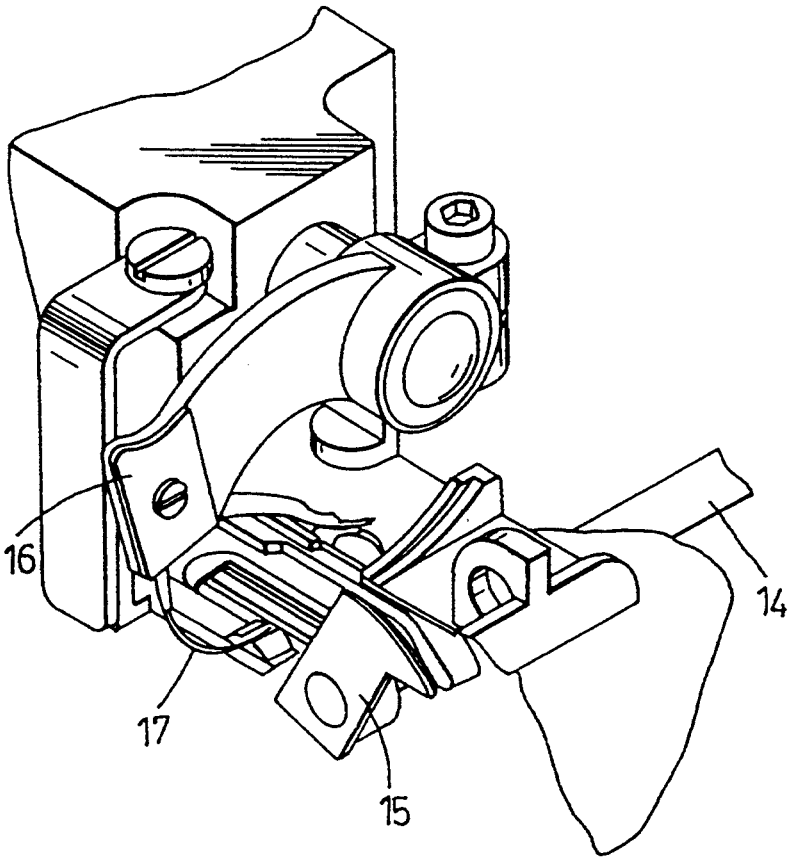
FIG.2 PRIOR ART
FIG. 2 is a fragmentary perspective view showing a portion of the conventional blind stitch sewing machine.
Figure 3B:
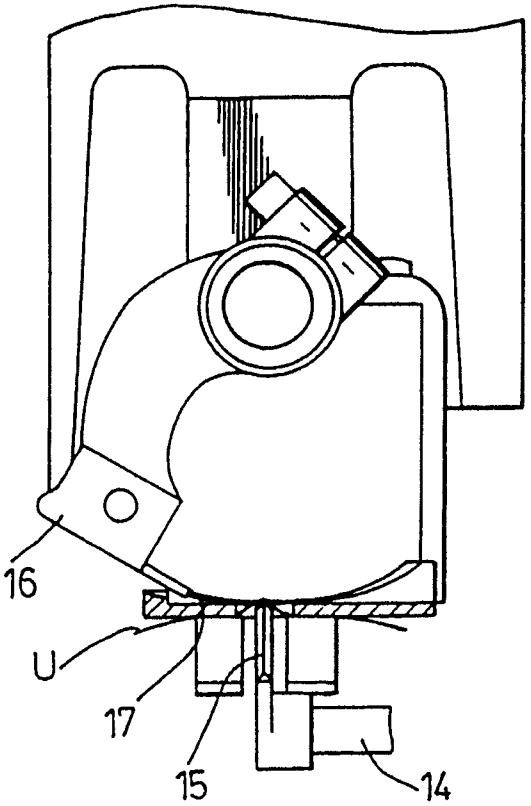
FIG. 3B PRIOR ART
FIGS. 3A and 3B are fragmentary front views of the portion of the conventional blind stitch sewing machine shown in FIG. 2.
Figure 3A:
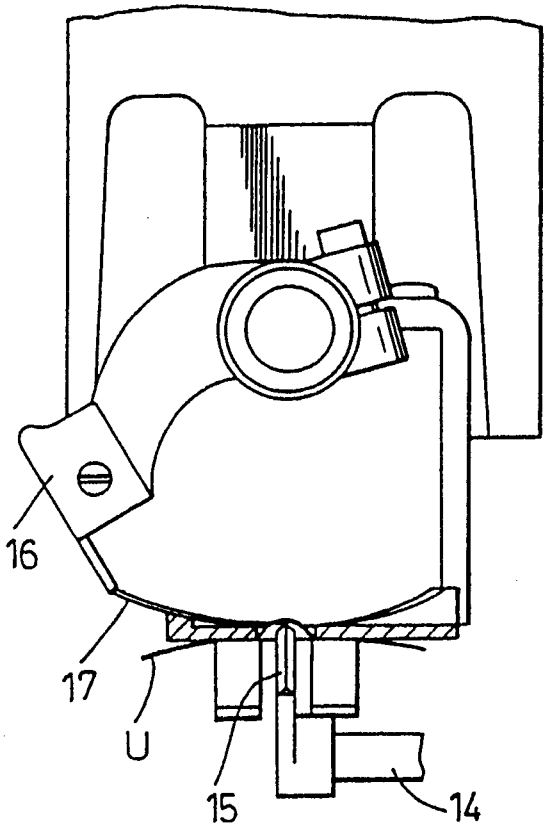
FIG. 3A PRIOR ART
Figure 4:
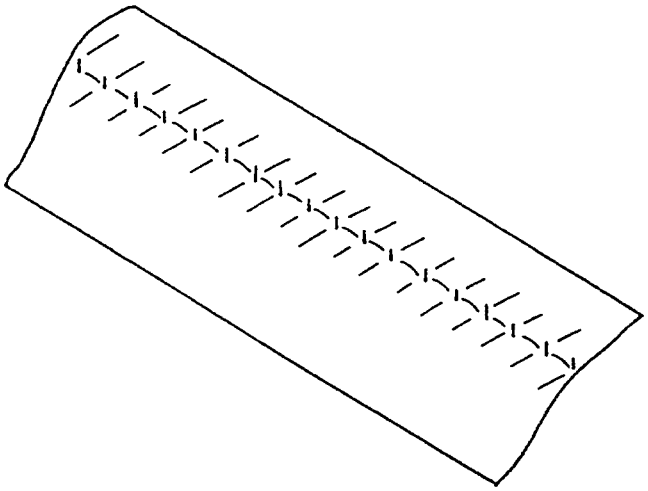
FIG. 4 PRIOR ART
FIG. 4 is a fragmentary perspective view showing an undesired stitching pattern on a fabric unit sewn by the conventional blind stitch sewing machine.
Figure 5:
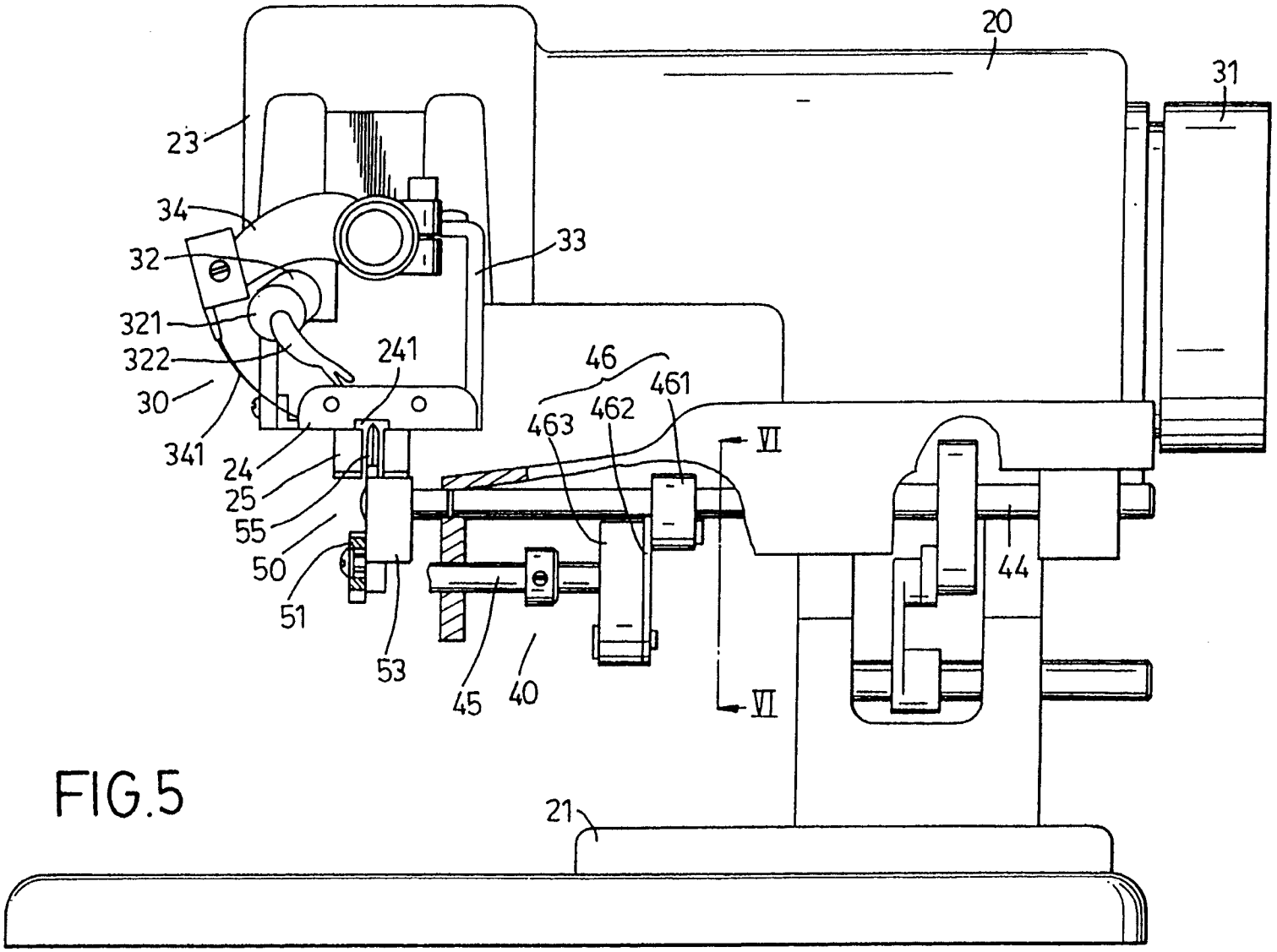
FIG. 5 is a fragmentary front view of a blind stitch sewing machine according to this invention.
Figure 6:
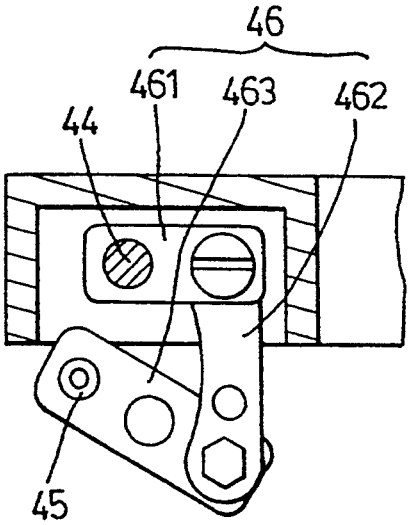
FIG. 6 is a partly sectional view taken along line VI—VI in FIG. 5.
Figure 8:
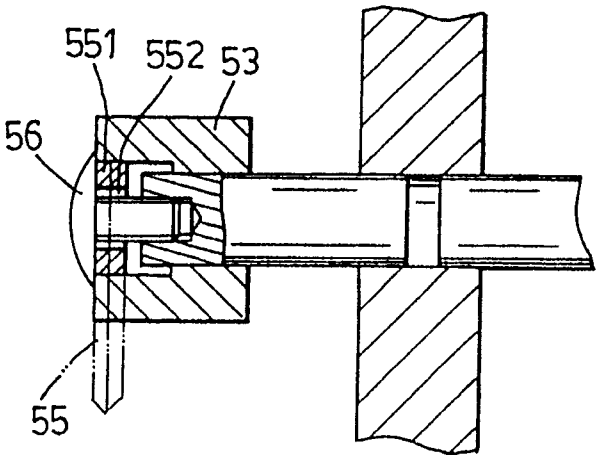
FIG. 8 is a partly sectional view taken along line VIII—VIII in FIG. 7.
Figure 7:
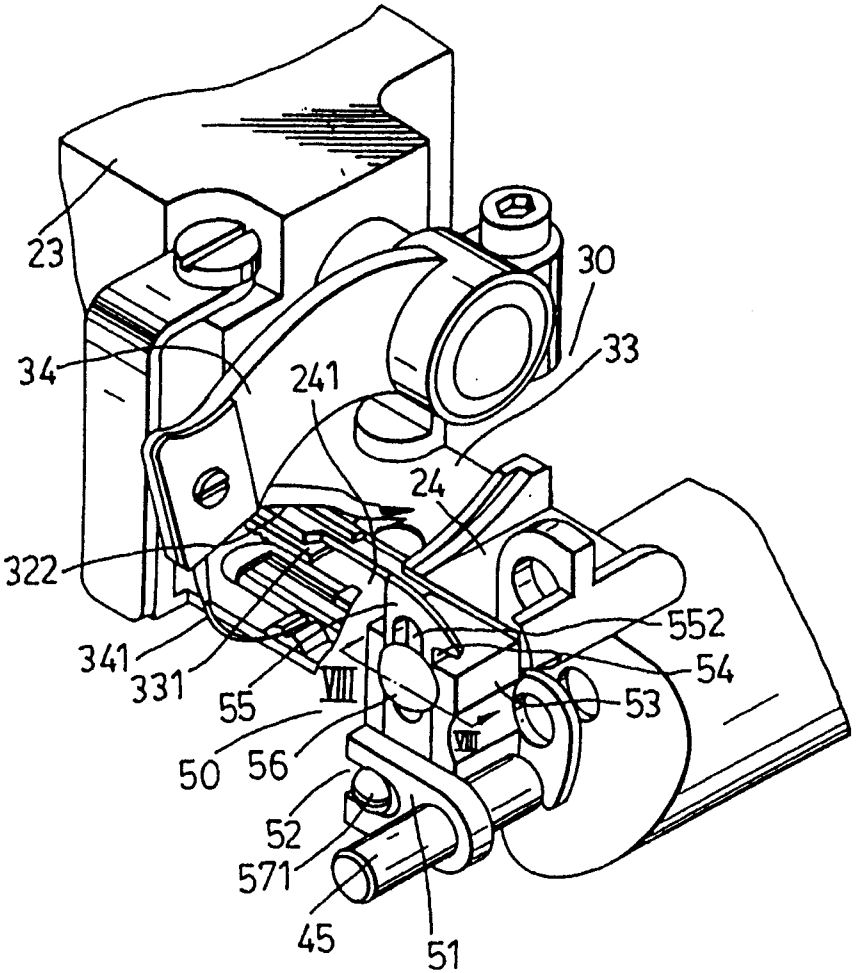
FIG. 7 is a fragmentary perspective view showing a portion of the blind stitch sewing machine according to this invention.
Figure 10:
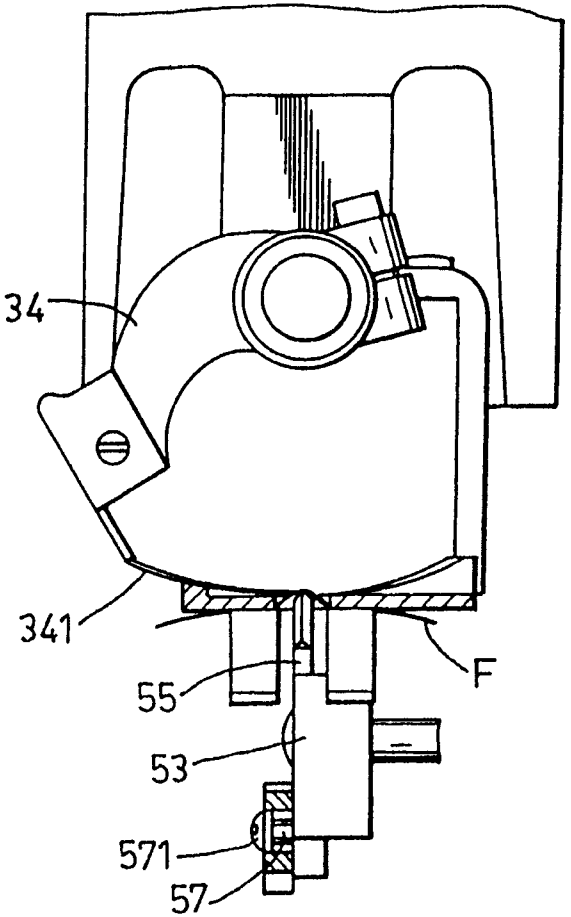
FIG. 10 is a partly sectional view taken along line X—X in FIG. 9.

The driving unit (40) includes a motor (not shown) which is adapted to be installed in the main housing (20), a main shaft (44), an auxiliary shaft (45), a first transmission assembly (46), and a second transmission assembly (50). The conventional mechanisms of the needle mechanism (30) are coupled with the motor of the driving unit (40). The main shaft (44) is journalled on the machine table (21) and is coupled with the motor so as to be drivable to effect a uni-directional rotation. The first transmission assembly (46) interconnects the main shaft (44) and the auxiliary shaft (45) so as to convert the uni-directional rotation of the main shaft (44) into reciprocal rotation of the auxiliary shaft (45). The first transmission assembly (46) includes a first elongated swing member (461), a link (462) and a second elongated swing member (463). As shown in FIG. 6, the first elongated swing member (461) has a first end connected securely to the main shaft (44) and a second end. The second elongated swing member (463) has a first end connected securely to the auxiliary shaft (45) and a second end. The link (462) interconnects pivotally the second ends of the first and second elongated swing members (461,463) in such a manner that the rotation of the main shaft (44) is converted into the reciprocal rotation of the auxiliary shaft (45). The second transmission assembly (50) interconnects the auxiliary shaft (45) and the fabric pushing member (55) so as to convert the reciprocal rotation of the auxiliary shaft (45) into reciprocal vertical movement of the fabric pushing member (55). The second transmission assembly (50) includes an elongated connecting member (51), a connecting rod (57) (see FIG. 10) and a seat member (53). The connecting member (51) is connected securely to the auxiliary shaft (45) at one end and has a longitudinal slide slot (52) formed in the other end. The connecting rod (57) is connected securely to the fabric pushing member (55) and engages movably within the slide slot (52) of the connecting member (51) at an end thereof. The connecting rod (57) has an enlarged head (571) at the end, which enlarged head (571) engages movably within the slide slot (52) of the connecting member (51) so as to prevent disengagement of the connecting rod (57) from the slide slot (52) of the connecting member (51). The seat member (53) is fixed on the machine table (21) and has a vertical slide groove (54) in which the fabric pushing member (55) slidably engages. The fabric pushing member (55) has an engaging slot (552) formed therein. The engaging slot (552) is parallel to the groove (54) of the seat member (53). The first end of a positioning rod (56) (see FIG. 8) extends through the engaging slot (552) of the fabric pushing member (55) and is connected securely to the seat member (53), while the second end of the positioning rod (56) has an enlarged head portion so as to prevent the untimely disengagement of the fabric pushing member (55) from the groove (54) of the seat member (53).

Referring to FIGS. 9, 10, 11, and 12, when in operation, rotation of the main shaft (44) is converted into the reciprocal rotation of the auxiliary shaft (45) by the first transmission assembly (46). When the auxiliary shaft (45) is rotated in one direction, the connecting member (51) is rotated synchronously with the auxiliary shaft (45) so as to move the connecting rod (57) along the slide slot (52) of the connecting member (51) in such a manner that the fabric pushing member (55) is moved upward in the groove (54) of the seat member (53) and through the stitching hole (241) of the stationary plate (24) in order to push a portion of the fabric unit (F) upward for sewing. At the same time, the thread guiding unit (32) and the needle unit (34) are driven to pivot so as to cooperatively put a stitch on the portion of the fabric unit (F) which extends through the stitching hole (241) of the stationary plate (24). When one stitch has been put on the portion of the fabric unit (F), the auxiliary shaft (45) is rotated in the opposite direction so as to move the connecting rod (57) along the slide slot (52) of the connecting member (51) in such a manner that the fabric pushing member (55) is moved downward in the groove (54) of the seat member (53), wherein the fabric pushing member (55) is away from the fabric unit (F). At this time, the feed dog element (331) is driven to feed the fabric unit (F) smoothly in a forward direction in order to put a succeeding stitch on the fabric unit (F).

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A blind stitch sewing machine including a stationary plate having a stitching hole formed therein, a presser member being movable to press against said stationary plate and cooperating with said stationary plate to define a fabric passage therebetween, a needle unit having a needle which is driven pivotally in order to put stitches on a fabric unit advanced through said fabric passage, a fabric pushing member drivable to push a portion of said fabric unit upward and through said stitching hole of said stationary plate so as to permit said needle to put one of said stitches on said portion of said fabric unit, and a driving unit including a main shaft which is drivable to effect unidirectional rotation, an auxiliary shaft, a first transmission assembly which interconnects said main shaft and said auxiliary shaft so as to convert the unidirectional rotation of said main shaft into reciprocal rotation of said auxiliary shaft, and a second transmission assembly which interconnects said auxiliary shaft and said fabric pushing member so as to convert the reciprocal rotation of said auxiliary shaft into reciprocal vertical movement of said fabric pushing member, wherein said second transmission assembly comprises:

an elongated connecting member which is connected securely to said auxiliary shaft at one end and which has a longitudinal slide slot formed in the other end, a connecting rod which is connected securely to said fabric pushing member and which engages movably within said slide slot of said connecting member at an end thereof, and a seat member which is fixed on said machine table and which has a vertical slide groove in which said fabric pushing member slidably engages.

2. The sewing machine of claim 1, wherein said first transmission assembly includes a first elongated swing member having a first end connected securely to said main shaft and a second end, a second elongated swing member having a first end connected securely to said auxiliary shaft and a second end, and a link pivotally interconnecting said second ends of said first and second elongated swing members in such a manner that the rotation of said main shaft is converted into the reciprocal motion of said auxiliary shaft.

* * * * *